US006431156B1

(12) United States Patent
Murakami et al.

(10) Patent No.: US 6,431,156 B1
(45) Date of Patent: Aug. 13, 2002

(54) VAPORIZED FUEL PROCESSING DEVICE

(75) Inventors: Kenichi Murakami, Nagoya; Satomi Wada, Handa, both of (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 09/696,202

(22) Filed: Oct. 26, 2000

(30) Foreign Application Priority Data

Apr. 11, 1999 (JP) ..... 11-350630

(51) Int. Cl.[7] ..... F02M 37/04
(52) U.S. Cl. ..... 123/520; 123/516
(58) Field of Search ..... 123/516, 520, 123/521, 518, 519, 198 D

(56) References Cited

U.S. PATENT DOCUMENTS 5,562,083 A * 10/1996 Osanai ..... 123/519
5,579,742 A * 12/1996 Yamazaki et al. ..... 123/520
5,653,211 A * 8/1997 Ishikawa ..... 123/520
5,829,416 A * 11/1998 Teraoka et al. ..... 123/520
5,870,997 A * 2/1999 Mukai ..... 123/520
5,954,034 A * 9/1999 Takagi ..... 123/520
6,105,556 A * 8/2000 Takaku et al. ..... 123/520

FOREIGN PATENT DOCUMENTS

JP 8-284765 10/1996

* cited by examiner

*Primary Examiner*—Carl S. Miller
(74) *Attorney, Agent, or Firm*—Oliff & Berridge, PLC

(57) ABSTRACT

In a vaporized fuel processing device, a partition wall 5 divides an adsorbent chamber 3 in a canister 1 into two chambers; a first chamber 3*a* and a second chamber 3*b*. A purge port section 1*a* and a first tank port section 1*b* are opened in the first chamber 3*a*, and an atmosphere port 1*d* is opened to the second chamber 3*b*. A second tank port section 1*c* is opened to any one of the first and second chambers 3*a* and 3*b*. Opening/closing control valves are provided in predetermined positions; between the purge port section 1*a* and a purge port 8*a* of a throttle body 8, between the first tank port section 1*b* and a fuel tank 9, and between the second tank port section 1*c* and the fuel tank 9, to purge a proper amount of the vaporized fuel to the throttle body 8.

8 Claims, 5 Drawing Sheets

VAPORIZED FUEL PROCESSING DEVICE

BACKGROUND OF THE INVENTION

1. Field of the Invention

The present invention relates to a vaporized fuel processing device for an internal combustion engine, and more particular to a vaporized fuel processing device capable of separating vaporized fuel in accordance with load conditions of the engine to thereby suppress fluctuations in the fuel-air ratio and prevent a deterioration of an adsorbent in a canister.

2. Description of Related Art

There has been known a vaporized fuel processing device in which fuel vapor generated in a fuel tank of automobiles is provisionally adsorbed in a canister and then the adsorbed fuel vapor is subjected to a separation (which will be hereinafter as to "purge") process to be sucked in an engine when operated, and the fuel vapor burns in the engine. Such the device is disclosed in for example Japanese patent unexamined publication No. 8-284765. The device of this Japanese publication is constructed so that a purge passage for delivering the fuel vapor desorbed from an adsorbent provided in the canister to an air intake pipe of the engine can be changed over from one passage having a small opening area to the other having a large opening area, and vice versa. An appropriate purge passage is selected between the two passages based on an operating state of the engine and a concentration of the fuel vapor. A purged amount of the fuel vapor is controlled to a desired value by a flow rate control valve interposed in the downstream of the purge passages.

In the canister of the above device, however, the purge passages are arranged contiguously to a tank port through which vaporized fuel flows into the canister from a fuel tank. In the case where a large amount of vaporized fuel is generated in the fuel tank under high temperature conditions and the like, therefore, the concentration of the vaporized fuel to be sucked in the engine suddenly changes, resulting in excessive concentrations and fluctuations in the fuel-air ratio. This possibly may cause deterioration in a constituent of exhaust gas and reduction in operability of the engine. Since only a single passage is provided for supplying fuel vapor from the fuel tank to the canister, all the fuel vapor, in a small or large amount, is surely adsorbed in the adsorbent. As the number of repetitions of adsorption and purge increases, the degradation of the adsorbent is accelerated, thereby causing deterioration in the treatment or process capability of the canister.

SUMMARY OF THE INVENTION

The present invention has been made in view of the above circumstances and has an object to overcome the above problems and to provide a vaporized fuel processing device capable of controlling the concentration of fuel vapor to be sucked in an engine from a canister which adsorbs the fuel vapor, thereby preventing fluctuations in a fuel-air ratio at burning of the fuel vapor in the engine, and also capable of preventing degradation of an adsorbent in the canister.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a vaporized fuel processing device for processing to supply vaporized fuel generated in a fuel tank to an engine, the device including: a canister connected to the fuel tank and accommodating an adsorbent for adsorbing the vaporized fuel delivered from the fuel tank; first control means disposed between the fuel tank and the canister, the first control means being operated to supply the vaporized fuel to the canister when a pressure of the vaporized fuel in the fuel tank is a first predetermined pressure or below; second control means disposed between the fuel tank and canister, the second control means being operated to supply the vaporized fuel to the canister when the pressure of the vaporized fuel in the fuel tank exceeds a second predetermined pressure that is larger than the first predetermined pressure; and a control valve disposed in a passage through which the vaporized fuel is supplied from the canister to a throttle body.

According to another aspect of the present invention, there is provided a canister including: an adsorbent chamber which accommodates an adsorbent; a partition wall for dividing the adsorbent chamber into a first and second chambers; a purge port section and a first tank port section, each having an end opened to the first chamber; an atmosphere port section having an end opened to the second chamber; and a second tank port section having an end opened to any one of the first and second chambers.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of preferred embodiments of a vapor fuel processing device embodying the present invention will now be given referring to the accompanying drawings.

Figure 1:
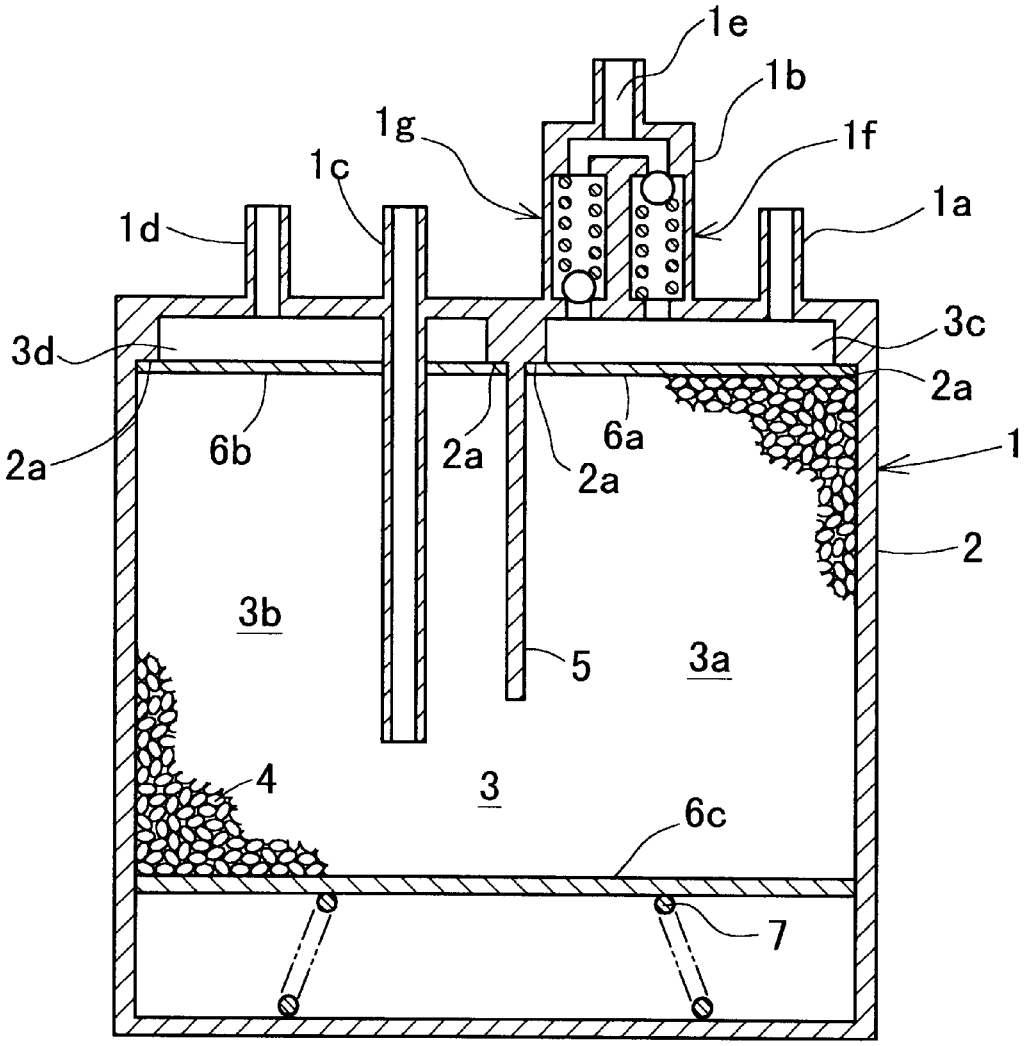
FIG. 1 is a longitudinal sectional view of a canister used in a vapor fuel processing device in a first embodiment according to the present invention.

FIG. 1 is a longitudinal sectional view of a canister used in the vapor fuel processing device in a first embodiment according to the present invention. In FIG. 1, a canister 1 is constructed of a main body 2 in which an adsorbent chamber 3 is formed for accommodating an adsorbent 4 made from activated carbon or the like. The adsorbent chamber 3 is partitioned into two chambers; a first chamber 3*a* and a second chamber 3*b*, by a partition wall 5. This partition wall 5 is integrally formed on the inside upper wall of the main body 2 with its end positioned at about a center of the adsorbent 4. The adsorbent 4 is sandwiched between filters 6*a* and 6*b* disposed in an upper wall side of the main body 2 and a filter 6*c* disposed in a bottom wall side. An elastic member 7 such as a spring arranged between the bottom wall of the main body 2 and the filter 6*c* to press the adsorbent 4 upward against stoppers 2*a* formed in the main body 2 at the upper wall side. Accordingly, two spaces 3*c* and 3*d* are formed in the upper portion of the adsorbent chamber 3 and partitioned by the partition wall 5. In the main body 2 at the first chamber 3*a* side, a purge port section 1*a* which is communicated with a purge port 8*a* of a throttle body 8 (see FIG. 3) and a first tank port section 1*b* which is communicated with a fuel tank 9 (see FIG. 3) are formed respectively, each having an end opened to the space 3*c* in the first chamber 3*a*.

In an inner passage 1*e* in the first tank port section 1*b*, there are side-by-side arranged a positive pressure check valve if and a negative pressure check valve 1*g* with both ends of the valves opened to the space 3*c*. In the main body 2 at the second chamber 3*b* side, on the other hand, an atmosphere port 1*d* and a second tank port section 1*c* are formed respectively. One end of the atmosphere port 1*d* is opened to the second chamber 3*d* and the other end is opened to the atmosphere. One end of the second tank port section 1*c* is opened at the center of the adsorbent In the present embodiment, the positive pressure check valve 1*f* is designed to open with a spring when the tank pressure is in a range of 2.9–4.7 kPa. The negative pressure check valve 1*g* is designed to open when the tank pressure is in a range of 0.5–1.2 kPa.

The operation of this negative pressure check valve 1*g* is explained below. The fuel vaporizing in the fuel tank 9 under high temperature conditions for example during the daytime is made to flow into the canister 1. As the temperature decreases during the nighttime, the vaporized fuel in the tank 9 is liquefied, thus causing a negative pressure in the tank 9. If the negative pressure becomes excessive, the tank 9 would be damaged, or dented. To prevent the damage, the tank 9 has to be supplied with the atmosphere through the canister 1 (the atmosphere port 1*d*). Accordingly, the check valve 1*g* operates to open when the pressure in the tank 9 is in a range of 0.5–1.2 kPa to supply the atmosphere into the tank 9.

Figure 2:
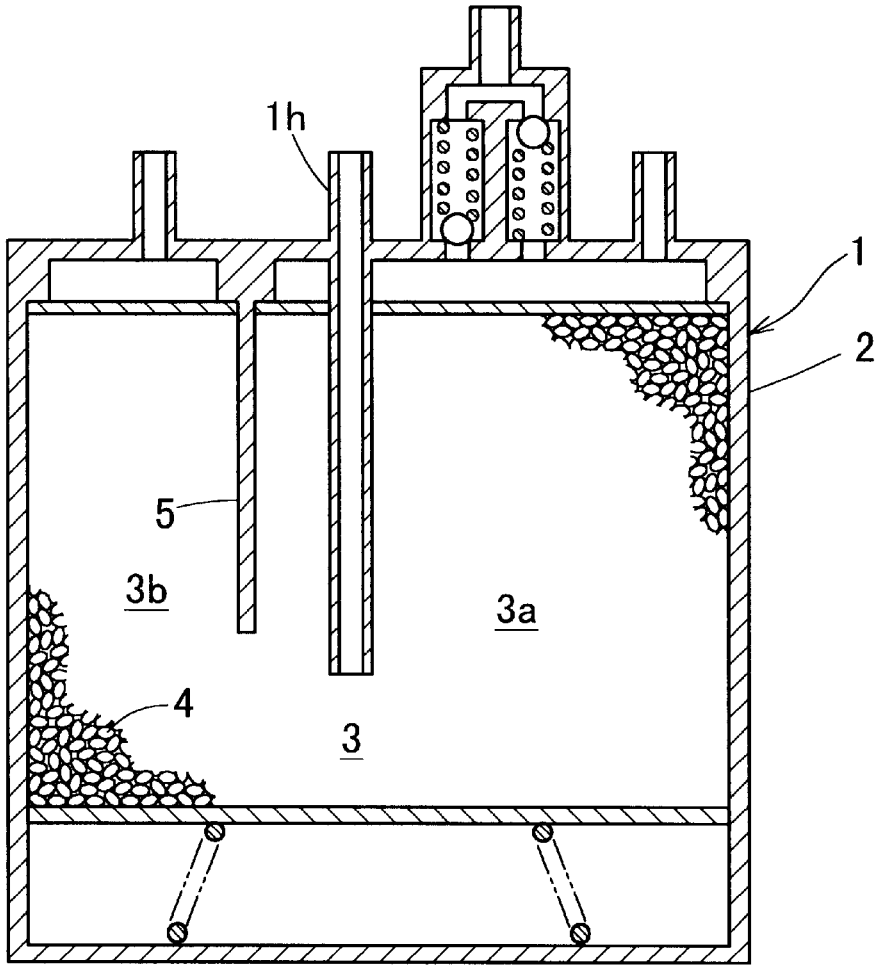
FIG. 2 is a longitudinal sectional view of a canister in a second embodiment.

FIG. 2 is a longitudinal sectional view of a vaporized fuel processing device in a second embodiment. The structure of the device in FIG. 2 is substantially the same as that in the first embodiment except for a second tank port section 1*h* provided in the main unit 2 at the first chamber 3*a* side. Also, since the operation and effect are the same between the first and second embodiments, only the first embodiment will be explained below with reference to FIG. 1.

Figure 3:
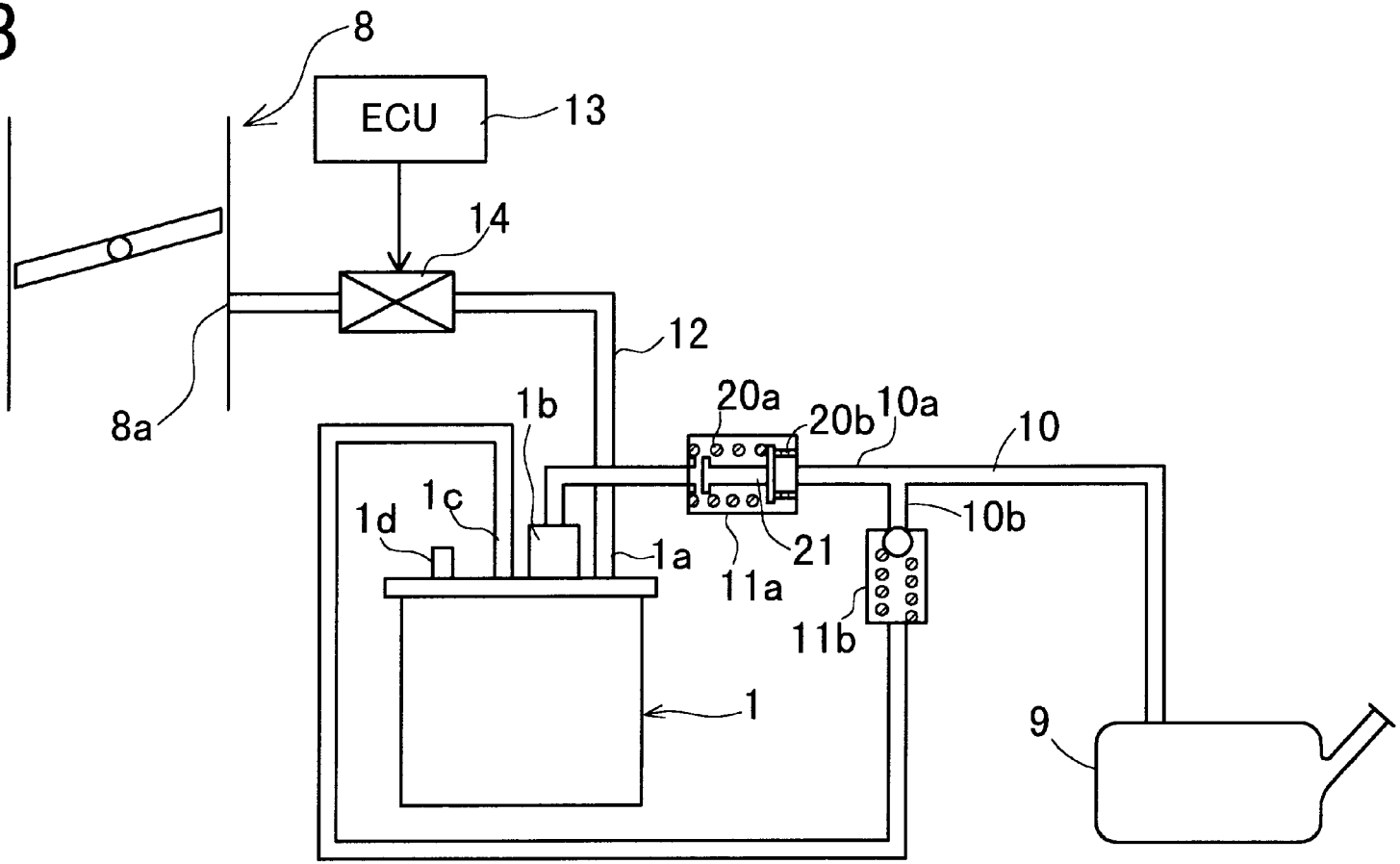
FIG. 3 is a schematic arrangement view of the vapor fuel processing device in the first embodiment.

FIG. 3 is a schematic arrangement view of the vaporized fuel processing device in the first embodiment. In FIG. 3, a vaporized fuel passage (pipe) 10 connected to the upper portion of the fuel tank 9 diverges into two passages 10*a* and 10*b*. One passage 10*a* is in communication with the first tank port section 1*b* through a first check valve 11*a*. The other passage 10*b* is in communication with the second tank port section 1*c* through a second check valve 11*b*. The first check valve 11*a* is designed to open when the pressure in the fuel tank 9 is at or below a predetermined value A and, on the other hand, close when the tank pressure exceeds the value A. To be more specific, a spring 20*a* provided in the first check valve 11*a* normally urges a valve body 21 in an opening direction (toward a stopper 20*b*) when the tank pressure is at or below the predetermined value A, thus opening the flow passage. When the tank pressure exceeds the predetermined value A, on the other hand, the valve body 21 is urged in a closing direction against the urging force of the spring 20*a*, thereby blocking the flow passage.

It is to be noted that the predetermined value A in the present embodiment is set at 5.7 kPa, larger by 1 kPa than the upper value of the valve opening setting range of the positive pressure check valve 1*f*.

The second check valve 11*b* is designed to close when the pressure in the fuel tank 9 is at or below a predetermined value B and open when the tank pressure exceeds the value B.

In the present embodiment, the predetermined value B is set at 6.2 kPa, larger by 0.5 kPa than the predetermined value A.

A passage 12 formed extending from the purge port section 1*a* is in communication with the purge port 8*a* of the throttle body 8 through a duty control valve 14 which will be controlled under signals from an ECU 13. The duty control valve 14 is constructed to open/close at a duty ratio selected from a map which has been determined in advance based on load conditions of the engine and stored in a memory not shown in the ECU 13, to properly control the purge amount.

Next, operation of the device in the present embodiment is explained, referring to FIGS. 1 and 3. When the pressure in the fuel tank 9 is lower than the valve closing pressure A of the first check valve 11*a*, showing that the amount of the vaporized fuel generated in the tank 9 is relatively small, the vaporized fuel is allowed to pass through the opened first check valve 11*a* and flow into the space 3*c* in the canister 1 through the first tank port section 1*b*.

In the present embodiment, the valve opening pressure of the positive pressure check valve 1*f* in the first tank port section 1*b* is smaller by 1 kPa than the valve closing pressure A of the first check valve 11*a*. Thus, the vaporized fuel after passing the first check valve 11*a* presses the positive pressure check valve 1*f* to open, and is easily delivered to the space 3*c*.

At this time, if the engine is operated and accordingly the duty control valve 14 is active to purge the vaporized fuel, the vaporized fuel flowed as above into the space 3*c* through the first tank port section 1*b* is allowed to flow into the passage 12 via the purge port section 1*a*, and purged to the purge port 8*a*. Accordingly, the amount of the vaporized fuel to be adsorbed in the adsorbent 4 through the filter 6*a* is reduced.

In this state, if the partition wall 5 is not provided, the atmosphere sucked through the atmosphere port 1*d* would directly flow into the purge port section 1*a* through the spaces 3*d* and 3*c* continuously formed, rarefying a fuel-air mixture to be supplied to the engine, thereby causing deterioration in operability of the engine. To the contrary, in the present embodiment, the partition wall 5 prevents the atmosphere sucked through the atmosphere port 1*d* from directly flowing into the purge port section 1*a*. This makes it possible to prevent reduction in the concentration of the fuel-air mixture to be supplied to the engine, and thus to prevent deterioration in operability of the engine.

On the other hand, when the duty control valve 14 is closed (at the stop of the engine), the vaporized fuel delivered to the space 3*c* through the first tank port section 1*b* is adsorbed in the adsorbent 4 in the first chamber 3*a* through the filter 6*a*. After that, when the engine is operated, the fuel is desorbed from the adsorbent 4 and purged to the purge port 8.

The positive pressure check valve 1*f* functions in the following manner. In the case of a small amount of the vaporized fuel generated in the fuel tank 9, the pressure in the fuel tank 9 is low. In the present embodiment, if the tank pressure is less than 2.9 kPa, there is no necessary to deliver the vaporized fuel to the canister 1. At this time, the positive pressure check valve 1*f* is held closed. The check valve 1*f* thus prevents the adsorbent 4 in the canister 1 from unnecessarily adsorbing the vaporized fuel to prevent the deterioration of the adsorbent 4.

When the pressure in the tank 9 exceeds the valve opening pressure B of the second check valve 11, which shows that the amount of the vaporized fuel generated in the tank 9 is large, the vaporized fuel presses the second check valve 11*b* to open, delivered to the canister 1 through the second tank port section 1*c* whose end is opened to the center of the adsorbent chamber 3, and adsorbed in the adsorbent 4. Since the pressure setting of the first check valve 11*a* is determined so as to close at this time, the flow of the vaporized fuel toward the first tank port section 1*b* through the passage 10*a* is interrupted by the closed first check valve 11*a*. The vaporized fuel with a high concentration adsorbed in the adsorbent 4 is mixed with the atmosphere taken in the canister 1 through the atmosphere port 1*d*. The fuel-air mixture in the adsorbent 4 is desorbed therefrom and sucked to the engine via the purge port section 1*a*. Accordingly, the variations in concentration of the vaporized fuel is smooth and the concentration is low, preventing the occurrence of excessive concentrations and fluctuations of the fuel-air ratio, and thereby causing no deterioration in a constituent of exhaust gas and no reduction in operability of the engine.

In the first embodiment, the space 3*c* is integrally or internally provided in the canister 1 to act as a flow passage for directly supplying the vaporized fuel generated in the fuel tank 9 to the throttle body 8. Accordingly, there is no need to provide an additional pipe for a direct flow passage, thus resulting in a compact device.

Figure 4:
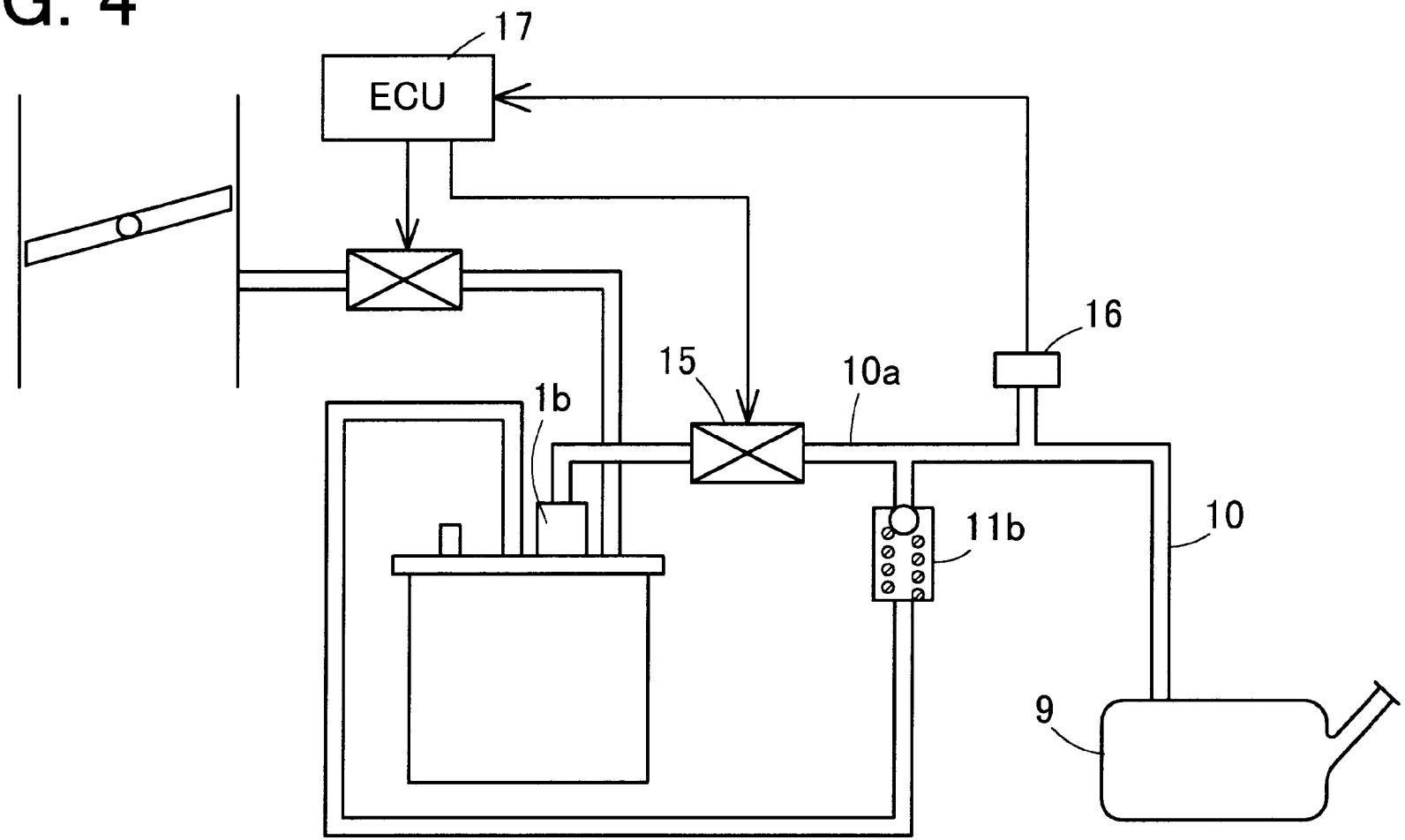
FIG. 4 is a schematic arrangement view of the vapor fuel processing device in the second embodiment.

The vaporized fuel processing device in the second embodiment is explained below with reference to FIG. 4. Only different parts from the first embodiment are described. In the second embodiment, as shown in FIG. 4, instead of the first check valve 11*a* (see FIG. 3), a solenoid opening/closing valve 15 is provided in the passage 10*a* providing communication between the first tank port section 1*b* and the fuel tank 9. A pressure sensor 16 for detecting the pressure in the fuel tank 9 is disposed in the vaporized fuel passage 10 disposed extending from the tank 9. The solenoid valve 15 is controlled to open/close under signals from an ECU 17 based on detection values by the pressure sensor 16. To be more specific, the solenoid valve 15 is opened when the tank pressure is at or below a predetermined value A and closed when the tank pressure exceeds the value A. It is to be noted that the operation of the device is the same as in the first embodiment, and the explanation is omitted.

Figure 5:
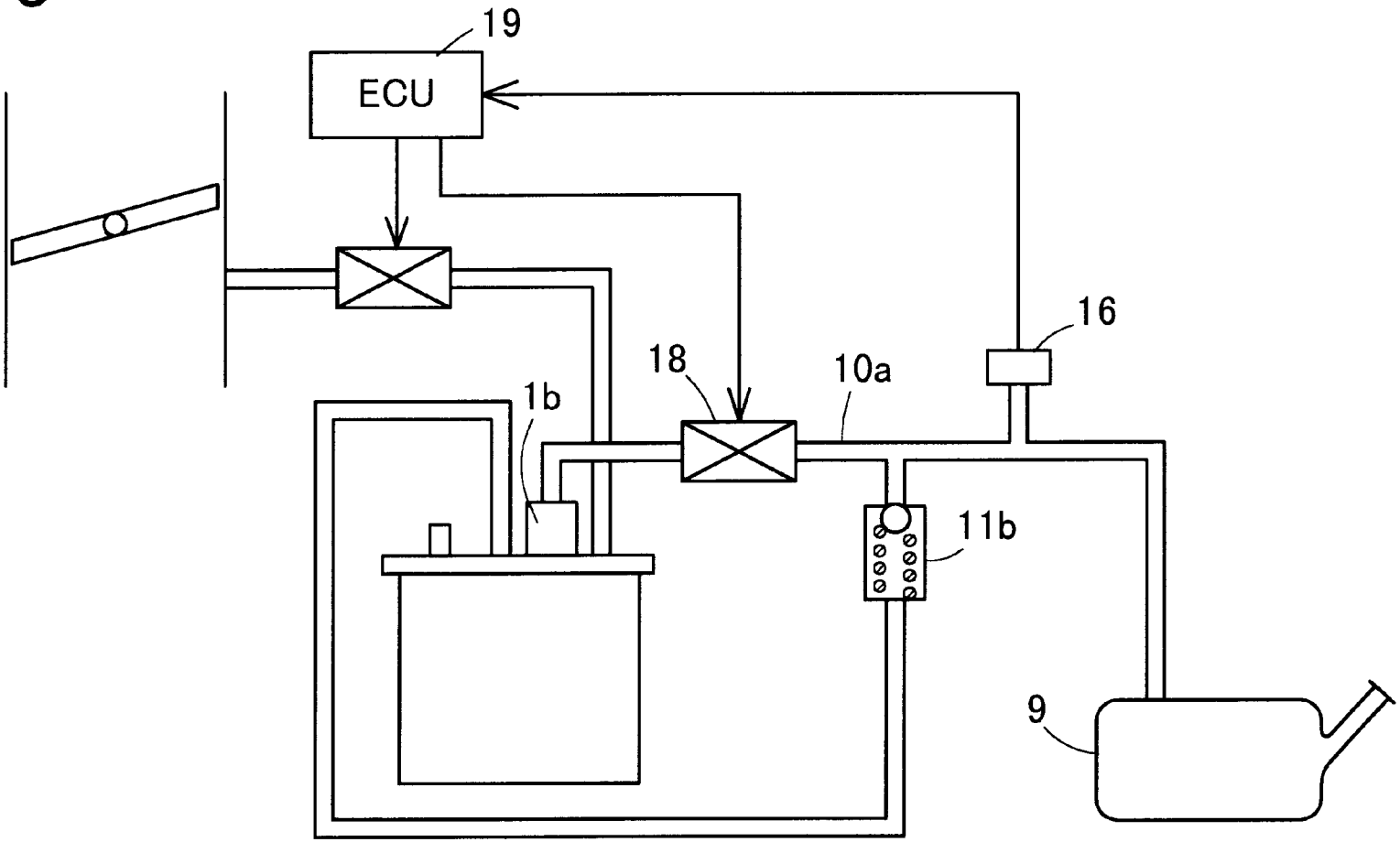
FIG. 5 is a schematic arrangement view of the vapor fuel processing device in a third embodiment.

Next, the vaporized fuel processing device in a third embodiment is explained with reference to FIG. 5. Only different parts or elements from the second embodiment are described. In the third embodiment, as shown in FIG. 5, instead of the solenoid valve 15, another duty control valve 18 is provided in the passage 10*a* connecting the first tank port section 1*b* and the fuel tank 9. The second duty control valve 18 is controlled to open/close under signals from an ECU 19 based on detection values by the pressure sensor 16. To be more specific, the valve 18 is opened when the pressure in the fuel tank 9 is at or below the predetermined value A and closed when the tank pressure exceeds the value A to block the passage 10*b*. The second duty control valve 18 is controlled not only to simply open/close but also to linearly control the amount of the vaporized fuel allowed to pass therethrough in response to a request, thus enabling control the passing amount of the vaporized fuel with higher accuracy. It is to be noted that the operation in the third embodiment is the same as in the second embodiment, and the explanation thereof is omitted.

The vaporized fuel processing device constructed as described in the above embodiments has the following effects. When a large amount of vaporized fuel is generated in the fuel tank, the vaporized fuel is delivered to the canister 1 through the second tank port section 1*c* or 1*h*, adsorbed in the adsorbent 4, and then sucked in the engine with atmosphere. Accordingly, the variation in concentration of the vaporized fuel is smooth and the concentration is low, providing no excessive concentrations and no fluctuations of the fuel-air ratio, thereby preventing the deterioration in a constituent of exhaust gas and the reduction in the operability of the engine. When a small amount of the vaporized fuel is generated in the fuel tank, the vaporized fuel delivered to the canister 1 through the first tank port section 1*b* is directly purged from the purge port section 1*a* to the purge port 8*a* of the throttle body 8 without passing through the adsorbent 4. This results in reduction in the number of repetitions of adsorption and purge, thus suppressing deterioration in the absorbent.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A vaporized fuel processing device for processing to supply vaporized fuel generated in a fuel tank to an engine, the device including:

a canister connected to the fuel tank and accommodating an adsorbent for adsorbing the vaporized fuel delivered from the fuel tank;

first control means disposed between the fuel tank and the canister, the first control means being operated to supply the vaporized fuel to the canister when a pressure of the vaporized fuel in the fuel tank is a first predetermined pressure or below;

second control means disposed between the fuel tank and canister, the second control means being operated to supply the vaporized fuel to the canister when the pressure of the vaporized fuel in the fuel tank exceeds a second predetermined pressure that is larger than the first predetermined pressure; and a control valve disposed in a passage through which the vaporized fuel is supplied from the canister to a throttle body.

2. The vaporized fuel processing device according to claim 1, wherein the canister is integrally provided with a flow passage for directly supplying the vaporized fuel supplied therein through the first control means to the control valve.

3. The vaporized fuel processing device according to claim 2, wherein the vaporized fuel supplied to the canister 1 through the first control means is supplied to the control valve through a flow passage provided in the canister during operation of the engine, while it is adsorbed in the adsorbent in the canister during stop of the engine.

4. The vaporized fuel processing device according to claim 1, wherein the canister is provided with a partition wall for dividing the adsorbent chamber into a first and second chambers, and the vaporized fuel supplied to the canister through the first control means is supplied to the first chamber, and the vaporized fuel supplied through the second control means is supplied to the second chamber.

5. The vaporized fuel processing device according to claim 2, wherein the first control means is an opening/closing valve constructed of a valve body and a spring urging the valve body in an opening direction, and the valve body is urged to close against an urging force of the spring when the pressure in the fuel tank exceeds the first predetermined pressure.

6. The vaporized fuel processing device according to claim 2, wherein the first control means is disposed in a first passage for supplying the vaporized fuel from the fuel tank to the canister and the second control means is disposed in a second passage for supplying the vaporized fuel from the fuel tank to the canister, and the first control means includes a pressure sensor for detecting the pressure in the fuel tank, and a blocking valve for blocking the first passage when the pressure sensor detects a pressure exceeding the first predetermined pressure.

7. The vaporized fuel processing device according to claim 6, wherein the blocking valve is a duty control valve.

8. The vaporized fuel processing device according to claim 1, wherein the canister is provided with:

an adsorbent chamber which accommodates the adsorbent;

a partition wall for dividing the adsorbent chamber into a first and a second chambers;

a purge port section and a first tank port section each having an end opened to the first chamber;

an atmosphere port section having an end opened to the second chamber; and a second tank port section having an end opened to any one of the first and second chambers.

* * * * *